US007578147B2

(12) United States Patent
Feldman-Abovitz

(10) Patent No.: US 7,578,147 B2
(45) Date of Patent: Aug. 25, 2009

(54) HAND-HELD TOOL FOR KNITTING OR CROCHETING

(76) Inventor: Debra Lynn Feldman-Abovitz, 4718 Roosevelt St., Hollywood, FL (US) 33021-4140

( * ) Notice: Subject to any disclaimer, the term of this patent is extended or adjusted under 35 U.S.C. 154(b) by 0 days.

(21) Appl. No.: 11/738,281

(22) Filed: Apr. 20, 2007

(65) Prior Publication Data

US 2007/0245775 A1 Oct. 25, 2007

Related U.S. Application Data

(60) Provisional application No. 60/793,500, filed on Apr. 20, 2006.

(51) Int. Cl.
*D04B 3/02* (2006.01)

(52) U.S. Cl. ..... 66/117; 66/1 A; 66/118

(58) Field of Classification Search ..... 66/1 R, 66/1 A, 116–118, 178 R, 179–185
See application file for complete search history.

(56) References Cited

U.S. PATENT DOCUMENTS

| | | | | | |
|---|---|---|---|---|---|
| 609,061 | A | * | 8/1898 | Waymack | 66/117 |
| 1,131,621 | A | * | 3/1915 | White | 66/118 |
| D52,973 | S | * | 2/1919 | Stansbery | D3/28 |
| D54,755 | S | * | 3/1920 | Kinney | D3/28 |
| 1,347,027 | A | * | 7/1920 | Green | 66/118 |
| 1,496,579 | A | * | 6/1924 | Kraus | 66/117 |
| 2,217,524 | A | * | 10/1940 | Neuschwanger et al. | 66/118 |
| D133,543 | S | * | 8/1942 | Megarry | D3/28 |
| D134,231 | S | * | 10/1942 | Shapiro | D3/28 |
| 2,443,540 | A | * | 6/1948 | Lewis | 66/117 |
| 2,465,636 | A | * | 3/1949 | Doerr | 66/118 |
| D154,971 | S | * | 8/1949 | Williamson | D3/28 |
| D157,818 | S | * | 3/1950 | Williamson | D3/28 |
| D157,819 | S | * | 3/1950 | Williamson | D3/28 |
| D157,820 | S | * | 3/1950 | Williamson | D3/28 |
| D157,821 | S | * | 3/1950 | Williamson | D3/28 |
| 2,544,429 | A | * | 3/1951 | Kadisch et al. | 66/117 |
| 2,608,076 | A | * | 8/1952 | Owens | 66/118 |
| 2,668,429 | A | * | 2/1954 | Sauers et al. | 66/117 |
| 4,047,397 | A | * | 9/1977 | Laliberte | 66/118 |
| D267,789 | S | * | 2/1983 | Winandy | D3/28 |
| D270,783 | S | * | 10/1983 | Okada | D3/28 |
| 4,607,505 | A | * | 8/1986 | Dunker et al. | 66/117 |
| 4,630,454 | A | * | 12/1986 | Seremjian | 66/1 A |
| 5,685,175 | A | * | 11/1997 | Flavin et al. | 66/1 A |

* cited by examiner

*Primary Examiner*—Danny Worrell
(74) *Attorney, Agent, or Firm*—Gardere Wynne Sewell LLP

(57) ABSTRACT

A hand-held knitting needle, crochet hook or similar tool for use in turning yarn into cloth or other material includes one or more holes, each of which is generally placed in a portion of the tool that does not interfere with use of the tool. Each hole is threaded with one or more decorative object supports, made from metals, ribbons, and leathers. Along the support may be strung or attached any combination of decorative objects. Decorative objects may include any number and kind of beads, gemstones, pearls, and other decorative objects.

7 Claims, 2 Drawing Sheets

HAND-HELD TOOL FOR KNITTING OR CROCHETING

CROSS-REFERENCE TO RELATED APPLICATION

This application claims priority to U.S. Provisional Application No. 60/793,500, entitled, Beaded Knitting Needle and Method of Manufacture, filed Apr. 20, 2006, which is incorporated herein by reference.

TECHNICAL FIELD OF THE INVENTION

The preferred embodiment of the present invention relates generally to hand-held tools used for knitting, crocheting and similar activities.

BACKGROUND OF THE INVENTION

Knitting needles and crochet hooks are examples of a class of elongated hand-held tools used for turning yarn, wire, thread or the like into cloth or other material without use of machinery. There are several different types of knitting needles and crochet hooks. One of the most common knitting needles is a straight knitting needle, although curved needles may also be used. The straight knitting needle 2 of FIG. 1 is representative of knitting needles, generally, and of a class of hand-held tools for knitting, crocheting and the like. The tools have an elongated portion that acts as a handle. In the case of a knitting needle, stitches are slipped onto the elongated portion. Such tools may be made of wood, bamboo, plastic, metal or other material or combination of materials. Knitting needle 2 is comprised of a relatively smooth shaft 4, having a substantially circular cross-section. It is long enough for slipping stitches during knitting while a hand grips it. This knitting needle, as is typical of most, narrows at one end to a dull point 6, which is used for forming stitches. The other end often possesses a head, such as knob 8 or other structure, for helping to keep stitches from falling off the end of needle. The knob or similar structure is typically either integrally formed with elongated portion of the needle during manufacture, or separately formed and attached. A crochet hook possesses a small hook for forming stitches.

SUMMARY OF THE INVENTION

The invention pertains generally to methods and structures for supporting decorative elements on knitting needles, crochet hooks and other elongated tools used for knitting, crocheting or similar activity.

Exemplary embodiments of the invention, in its preferred form, are described below in connection with the accompanying drawings.

DETAILED DESCRIPTION

In the following description, like numbers refer to like elements.

Figure 1:
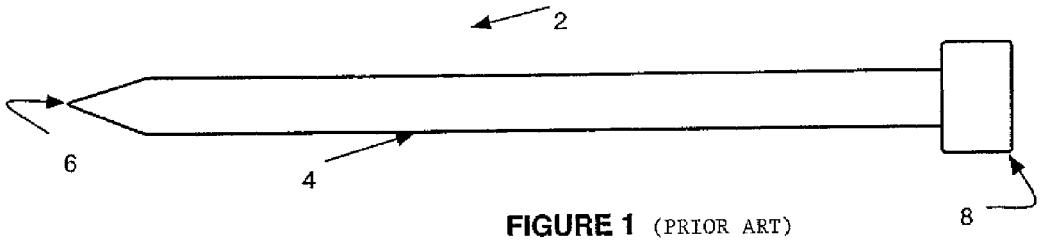
FIGURE 1 (PRIOR ART)
FIG. 1 is a side view of a representative example of a prior art, straight knitting needle.
Figure 2A:
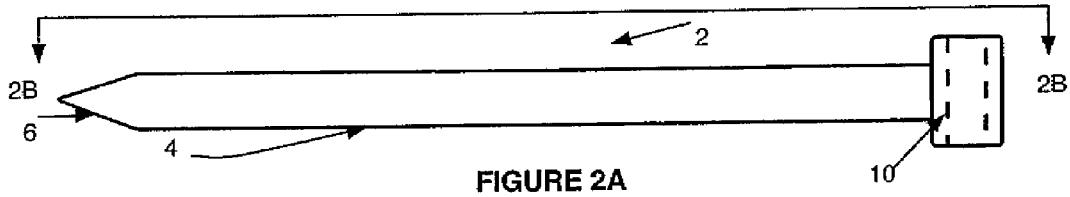
FIG. 2A is a top view of a knitting needle.
Figure 2B:
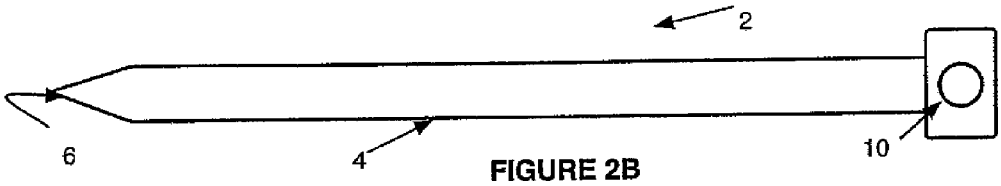
FIG. 2B is a side view of the knitting needle of FIG. 2A.

Referring to FIGS. 2A and 2B, straight knitting needle 2 is a representative example of a class of elongated hand-held tools used for turning yarn, wire, thread or the like into cloth or other material without use of machinery. Crochet hooks are also an example of such tools. A hole 10 is formed through a portion of a knitting needle 2, through which a support is threaded for mounting decorative objects to the needle in a manner that does not interfere with the working end of the needle or with slipping stitches. Preferably, the hole is located remotely from the working end of the elongated tool. The hole may be formed by drilling or other machining operation. It may also be formed by other methods, such as during molding of a plastic needle. Preferably, the hole is located in the head of the needle, but may also be formed in the shaft of the needle, or in any other portion of the needed, where it or objects extending through it would not substantially interfere with slipping stitches. The center axis of the hole need not be straight or perpendicular to the axis of the needle.

Figure 3:
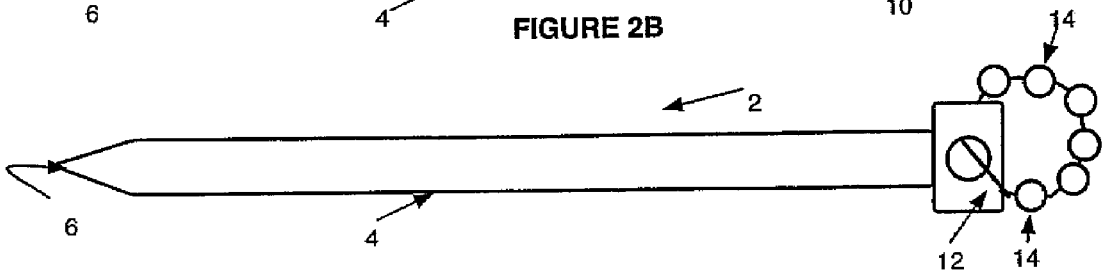
FIG. 3 is a side view of the knitting needle of FIG. 2B, on which is formed an example of a first bead assembly.

Referring to FIG. 3, wire 12 (sterling silver, gold, gold-plated, silver-plated, copper, or other metal) or ribbon, leather, twine, cord, rope, or some other material that functions as a support for beads and other decorative objects, is threaded through the hole, to which will be mounted, such as by stringing, gluing, soldering, clipping, or wiring, beads 14, or any other decorative object that may be strung, attached to, or otherwise formed on or with the support extending through the hole, such as, for example, gemstones, charms, pearls, or wire. Collectively, the support mounted with decorative objects will be referred to as a decorative object assembly. A support may take any number of forms. For example, it may be joined after being threaded through the hole to form one or more loops. Preferably, it is tied, bent or joined in some fashion to retain the decorative objects and prevent the decorative objects assembly from falling off the needle, while also permitting movement of the decorative objects and/or support. Additionally, portions of the support can be formed into one or more decorative features. Such decorative features will be, unless otherwise noted, considered to be a decorative object, notwithstanding that they are integrally formed out of, or with, the support. This method of attaching decorative objects to the knitting needle allows for creation of kinetic or moving decorative object arrangements attached to the knitting needle.

A preferred embodiment therefore contemplates one or more holes, each of which is generally placed in a portion of the tool that does not interfere with its use or with the activity. In the case of a needle, the holes are preferably placed in a portion that is not used for slipping the stitches while knitting, such as the end knob or other feature for preventing stitches from falling off Each hole is threaded with one or more decorative object supports, with metals, ribbons, and leathers being the preferred embodiments. Along a support is mounted one or more decorative objects. The decorative objects may include any number and kind of beads, gemstones, pearls, and other decorative objects. Each decorative object may be fixed in position along the support, or free to slide or otherwise move along the support.

In another exemplary embodiment, additional decorative objects may also be directly affixed to the needle in combination with the decorative bead assembly extending through at least one hole.

Figure 4:
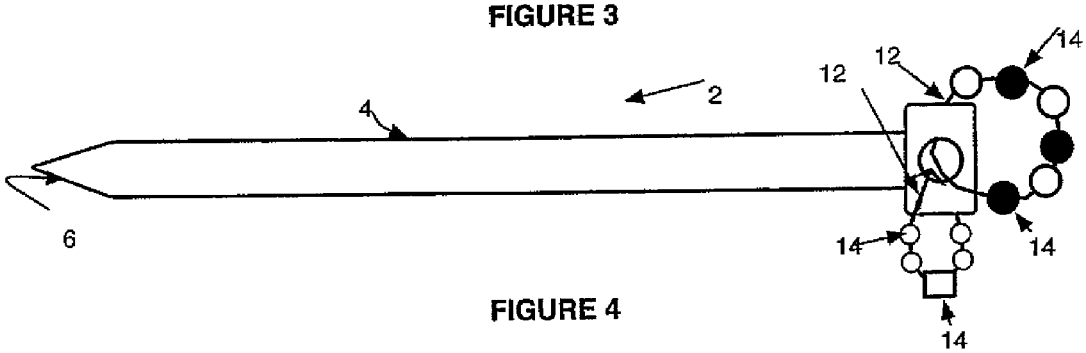
FIG. 4 is a side view of the knitting needle of FIG. 2B, on which is formed an example of a second bead assembly.
Figure 5:
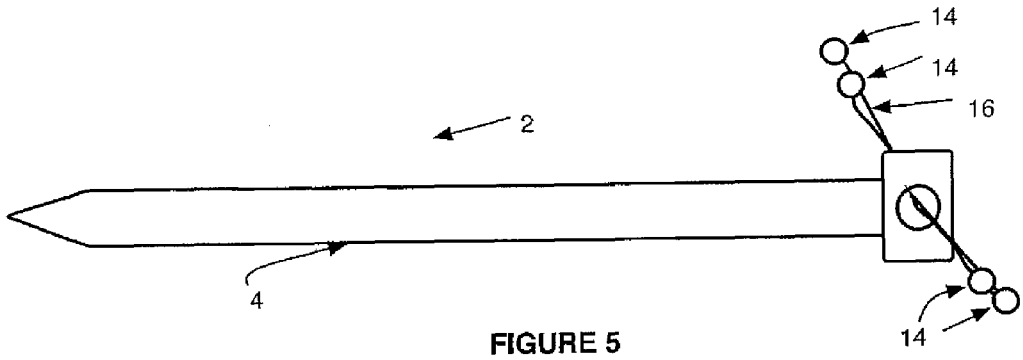
FIG. 5 is a side view of the knitting needle of FIG. 2B, on which is formed an example of a third bead assembly.
Figure 6:
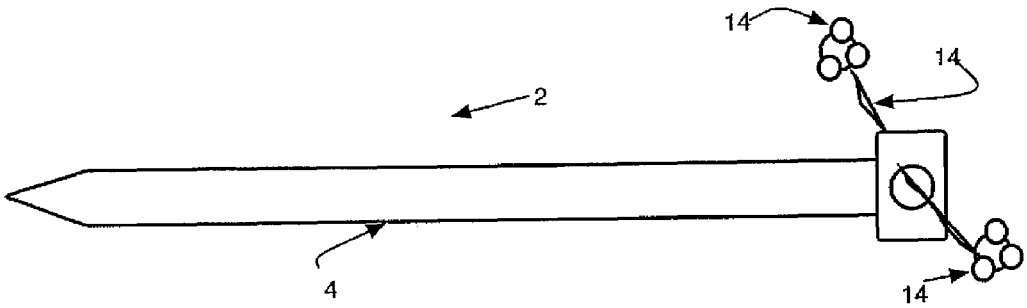
FIG. 6 is a side view of the knitting needle of FIG. 2B, on which is formed an example of a fourth bead assembly.
Figure 7:
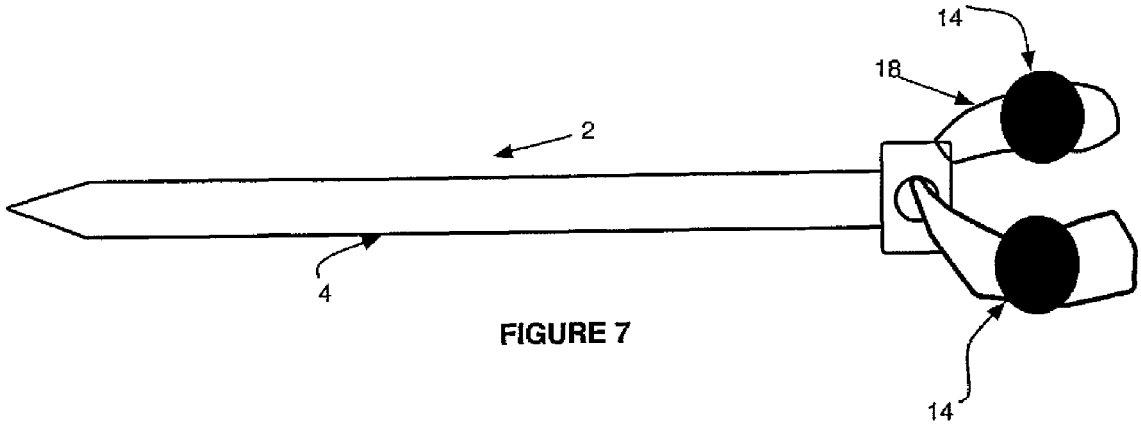
FIG. 7 is a side view of the knitting needle of FIG. 2B, on which is formed an example of a fifth bead assembly.

FIGS. 4-7 illustrate several examples of different decorative object assemblies. FIG. 4 illustrates an example in which multiple supports extend through one hole. FIG. 5 illustrates an example of a decorated knitting needle having a support 16 that is not connected to itself in a manner that forms a continuous loop extending through the hole. Rather, it is elongated. In the example of FIG. 6, the support is elongated but includes looped ends. In these two examples, the decorative objects function to keep the support within the hole of the needle. The support shown in the example of FIG. 7 includes a ribbon tied to or extending through the hole, to which beads are attached. The beads assist with keeping the ribbon within the confines of the hole.

What is claimed is:

1. An elongated, hand-held tool for use in turning yarn into material, the tool comprising an elongated element having a working end configured for forming stitches and an end-portion opposite the working end having a larger diameter than the elongated portion; a hole being defined through the end-portion of the elongated element; a support structure extending through the hole; and at least one decorative element mounted on the support structure, the decorative element being comprised of at least one of a bead, gemstone, charm, pearl or other decorative object; wherein the hole is located in a location that does not interfere with slipping stitches onto the elongated element;

the support structure supports the decorative element mounted in a position that does not interfere with slipping stitches onto the one end of the elongated element configured for forming stitches; and the support structure is comprised of a plurality of unconnected, elongated support elements extending through the hole, each carrying at least a decorative element; at least one of the plurality of support elements being comprised of an elongated wire carrying the at least one decorative element, the at least one decorative element cooperating with the elongated element for retaining the support structure within the hole.

2. The elongated, hand-held tool for use in turning yarn into material of claim 1, wherein the plurality of support structures are further comprised of a closed, elongated support element extending through the hole.

3. The elongated, hand-held tool for use in turning yarn into material of claim 1, wherein the support structure is comprised of at least one length of wire.

4. The elongated, hand-held tool for use in turning yarn into material of claim 1, wherein the support structure is comprised of at least one length of ribbon.

5. An elongated, hand-held tool for use in turning yarn into material, the tool comprising:

an elongated element having one end configured for forming stitches;

a hole being defined through a portion of the elongated element;

a support structure extending through the hole without being fixedly attached to the tool, thereby permitting movement of the support structure relative to the tool; and at least one decorative element mounted on the support structure, the decorative element being comprised of at least one of a bead, gemstone, charm, pearl or other decorative object;

wherein the hole is located in a location that does not interfere with slipping stitches onto the elongated element;

wherein the support structure supports the decorative element mounted in a position that does not interfere with slipping stitches onto the one end of the elongated element configured for forming stitches;

wherein the support structure is comprised of an open, elongated wire extending through the hole and at least one decorative element that cooperates with the wire for retaining the support structure within the hole; and wherein the elongated element includes an elongated portion and an end-portion of larger diameter than the elongated portion, the hole being defined through the end-portion.

6. The elongated, hand-held tool for use in turning yarn into material of claim 5, wherein the support structure is further comprised of a closed, elongated support element extending through the hole and supporting at least one decorative element.

7. The elongated, hand-held tool for use in turning yarn into material of claim 5, wherein the support structure is comprised of at least one length of ribbon.

* * * * *